United States Patent [19]

Fantuzzo

[11] Patent Number: 4,682,874

[45] Date of Patent: Jul. 28, 1987

[54] PARTICLE LEVEL INDICATOR

[75] Inventor: Joseph Fantuzzo, Webster, N.Y.

[73] Assignee: Xerox Corporation, Stamford, Conn.

[21] Appl. No.: 322,801

[22] Filed: Nov. 19, 1981

[51] Int. Cl.[4] ..... G03G 15/08

[52] U.S. Cl. ..... 355/3 DD; 355/14 D; 118/653; 118/688

[58] Field of Search ..... 355/3 DD, 14 D; 118/653, 651, 652, 636, 657, 688; 200/61.21, 84 C; 222/DIG. 1, 23, 232

[56] References Cited

U.S. PATENT DOCUMENTS

| | | | |
|---|---|---|---|
| 3,659,556 | 5/1972 | Mutschler | 118/636 X |
| 3,896,279 | 7/1975 | Sugawara | 200/61.21 |
| 3,920,154 | 11/1975 | Sugawara | 222/23 |
| 4,155,638 | 5/1979 | Blitzer | 355/14 D |
| 4,176,941 | 12/1979 | Breitenkam et al. | 355/14 R |
| 4,241,696 | 12/1980 | Huzii | 355/14 D |
| 4,341,461 | 7/1982 | Fantozzi | 355/14 D |
| 4,343,548 | 8/1982 | Bares et al. | 355/14 D |

FOREIGN PATENT DOCUMENTS 5029145 7/1973 Japan .

*Primary Examiner*—A. C. Prescott

*Attorney, Agent, or Firm*—H. Fleischer; J. E. Beck; R. Zibelli

[57] ABSTRACT

An apparatus which detects when particles being dispensed into a development system have been depleted and provides a display of that condition. The apparatus advances particles from a store thereof to the development system. A detector, associated with the particle advancer, senses the exhaustion of particles being advanced to the development system.

13 Claims, 3 Drawing Figures

PARTICLE LEVEL INDICATOR

This invention relates generally to an electrophotographic printing machine, and more particularly concerns an improved apparatus for detecting the level of particles being dispensed into the development system of the printing machine from a storage container.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the powder image is heated to permanently affix it to the copy sheet in image configuration.

A suitable developer material frequently comprises carrier granules having toner particles adhering thereto. This two component mixture is brought into contact with the photoconductive surface. The toner particles are attracted from the carrier granules to the latent image. These toner particles adhere to the latent image so as to form a powder image on the photoconductive surface. It is thus apparent that during the development process toner particles are being continually depleted from the developer material. Additional toner particles must be furnished periodically to maintain copy density at a substantially optimum level. In order to produce an efficient printing machine, it is necessary to conveniently and effectively replace the toner particles used during the formation of the copies. It is apparent that as the toner particles are dispensed from the storage housing, the supply thereof becomes diminished. It is advantageous to have an apparatus associated with the toner dispenser for indicating when the supply of toner particles therein has been substantially depleted. This enables the machine operator to furnish additional toner particles for usage in the printing machine. In this way, copy density is maintained substantially uniform optimizing print quality.

Various approaches have been devised to detect the level of particles being dispensed from the toner particle storage housing. The following disclosures appear to be relevant:

U.S. Pat. No. 3,834,806
Patentee: Whited
Issued: Sept. 10, 1974
U.S. Pat. No. 3,896,279
Patentee: Sugawara
Issued: July 22, 1975
U.S. Pat. No. 3,920,154
Patentee: Sugawara
Issued: Nov. 18, 1975
U.S. Pat. No. 3,920,155
Patentee: Whited
Issued: Nov. 18, 1975
U.S. Pat. No. 3,979,022
Patentee: Whited
Issued: Sept. 7, 1976
U.S. Ser. No. 286,215

Applicant: Poehlein
Filed: July 23, 1981

The disclosures of the above-identified references may be briefly summarized as follows:

Whited ('806 and '155) disclose a magnetic plate mounted interiorly of an oscillating toner housing on a rod. A magnetic pick-up is disposed exteriorly of the housing adjacent the plate. An out-of-toner signal is generated when the plate oscillates relative to the housing, i.e. when the plate no longer contacts the toner particles in the housing.

Sugawara ('279) describes a pair of opposed blades mounted on a rotor. The blades are supported by the toner in the housing. As the toner supply is depleted, the rotor pivots the blades toward the horizontal. When the blades reach the horizontal, a switch is actuated which, in turn, energizes a display warning an operator of impending toner exhaustion.

Sugawara ('154) teaches a detector for sensing that the level of toner particles in a housing has dropped below a predetermined level. A flexible member extending across the reservoir actuates a switch in response to the toner level being below the predetermined level. The switch energizes a lamp warning the operator of this condition.

Whited ('022) discloses a toner level detector comprising a shaft having blades disposed in the toner of a housing.. A magnetic torque is applied to the shaft. The toner engaging the blades prevents the shaft from rotating. When the toner is spaced from the blades, the shaft rotates indicating a low level condition.

Poehlein describes a dispenser in which one helical auger intermingles developer material with toner particles and advances the mixture to a second helical auger. The second helical auger transports the mixture to the chamber of the housing storing the remainder of the developer material.

In accordance with one aspect of the features of the present invention, there is provided an apparatus for indicating the depletion of particles being dispensed into a development system. The apparatus includes means for storing a supply of particles therein. Means are provided for advancing particles received from the storing means to the development system. Means, operatively associated with the advancing means, detect the exhaustion of particles in the advancing means.

Pursuant to another aspect of the features of the present invention, there is provided an apparatus for developing an electrostatic latent image recorded on a photoconductive member. The apparatus includes a housing defining a chamber for storing a supply of developer material therein. A container stores a supply of toner particles therein. Means, disposed in the chamber of the housing, deposit developer material on the photoconductive member to develop the electrostatic latent image recorded thereon. Means are provided for advancing toner particles received from the container to the developer material in the chamber of the housing. Means, operatively associated with the advancing means, detect the exhaustion of particles in the advancing means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing maching will be shown hereinafter schematically and their operation described briefly with reference thereto.

Figure 1:
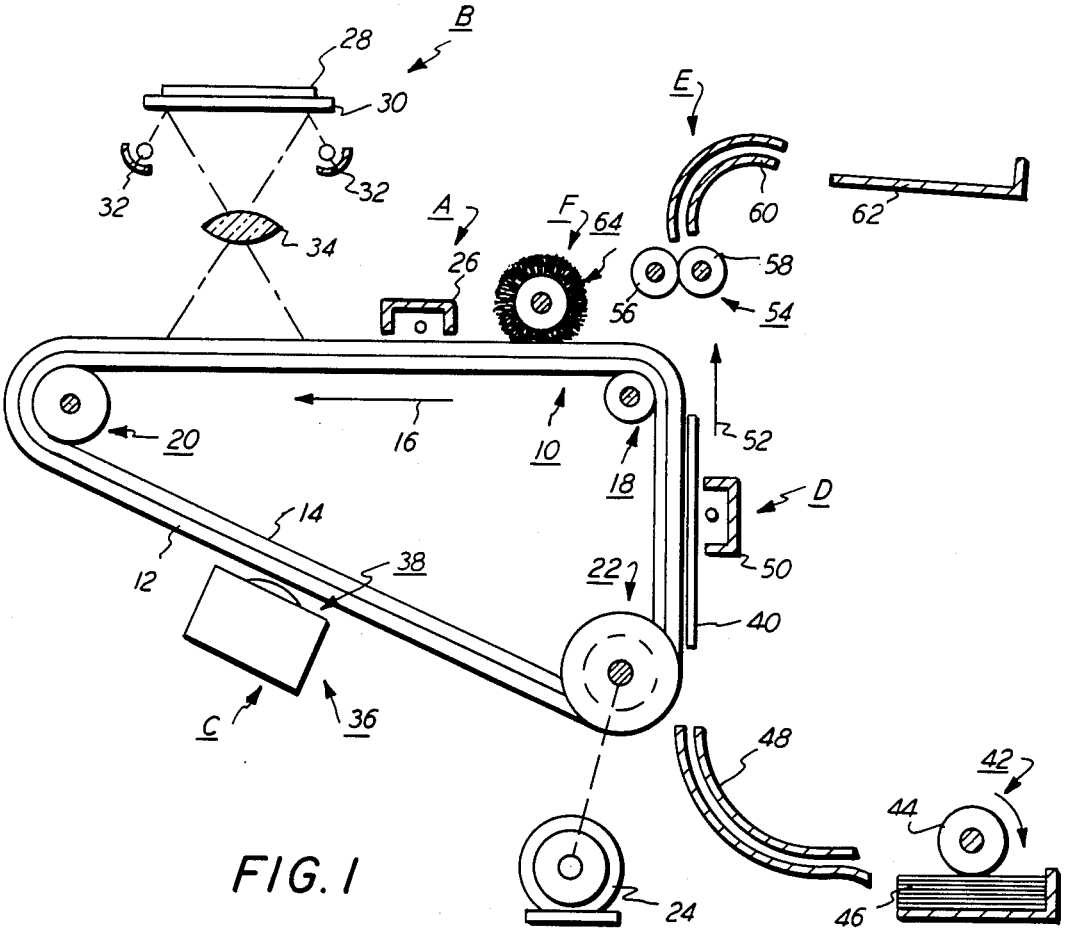
FIG. 1 is a schematic elevational view illustrating an electrophotographic printing maching incorporating the features of the present invention therein.

Turning now to FIG. 1, the electrophotographic printing machine employs a belt 10 having a photoconductive surface 12 deposited on a conductive substrate. Preferably, photoconductive surface 12 is made from a selenium alloy with conductive substrate 14 being made from an electrically grounded aluminum alloy. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned facedown upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image corresponding to the informational areas contained within the original document on photoconductive surface 12. Thereafter, belt 10 advances the electrostatic latent image recorded on photoconductive surface 12 to development station C.

At development station C, a magnetic brush development system, indicated generally by the reference numeral 36, transports a developer material of carrier granules and toner particles into contact with photoconductive surface 12. Magnetic brush development system 36 includes a developer roller 38 which advances the developer material into contact with photoconductive surface 12. The developer roller forms a brush comprising carrier granules and toner particles. The toner particles are attracted from the carrier granules to the electrostatic latent image forming a toner powder image on photoconductive surface 12 of belt 10. The detailed structure of magnetic brush development system 36 will be described hereinafter with reference to FIG. 2.

After development, belt 10 advances the toner powder image to transfer station D. At transfer station D, a sheet of support material 40 is moved into contact with the toner powder image. The sheet of support material is advanced to transfer station D by a sheet feeding apparatus 42. Preferably, sheet feeding apparatus 42 includes a feed roll 44 contacting the uppermost sheet of stack 46. Feed roll 44 rotates to advance the uppermost sheet from stack 46 into chute 48. chute 48 directs the advancing sheet of support material into contact with photoconductive surface 12 of belt 10 in a timed sequence so that the toner powder image developed thereon contacts the advancing sheet of support material at transfer station D.

Transfer station D includes corona generating device 50 which sprays ions onto the back side of sheet 40. This attracts the toner powder image from photoconductive surface 12 to sheet 40. After transfer, sheet 40 continues to move in the direction of arrow 52 onto a conveyor (not shown) which advances the sheet to fusing station E.

Fusing station E includes a fuser assembly, indicated generally by the reference numeral 54, which permanently affixes the transferred toner powder image to sheet 40. Preferably, fuser assembly 54 includes a heated fuser roller 56 and a backup roller 58. Sheet 40 passes between fuser roller 56 and backup roller 58 with the toner powder image contacting fuser roller 56. In this manner, the toner powder image is permanently affixed to sheet 40. After fusing, chute 60 guides the advancing sheet 40 to catch tray 62 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 64 in contact with photoconductive surface 12. The pre-clean corona generating device neutralizes the charge attracting particles to photoconductive surface 12. These particles are then cleaned from photoconductive surface 12 by the rotation of brush 64 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
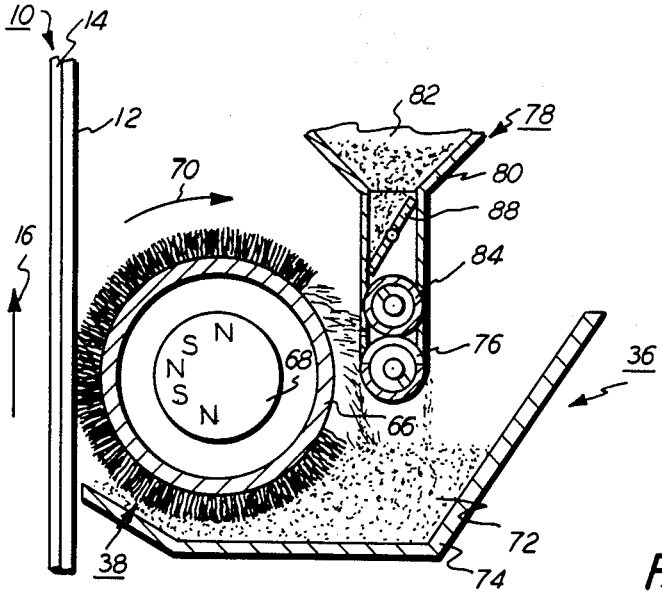
FIG. 2 is a schematic elevational view depicting the development system of the FIG. 1 printing machine.

Referring now to FIG. 2, there is shown development system 36 in greater detail. As depicted thereat, development system 36 includes a developer roller 38 having a non-magnetic tubular member 66. An elongated magnetic member 68 is positioned interiorly of tubular member 66 and spaced from the interior periphery thereof. Tubular member 66 rotates in the direction of arrow 70 to advance the developer material into contact with the electrostatic latent image recorded on photoconductive surface 12 of belt 10. Magnetic member 68 has a plurality of magnetic poles impressed about a portion thereof. Thus, as tubular member 66 rotates in the direction of arrow 70, it passes through the developer material in chamber 72 of housing 74. Developer material, disposed in chamber 72, is attracted to tubular member 66 via the magnetic field generated by elongated magnetic member 68. In this manner, the developer material is attracted to tubular member 66 and advances therewith into contact with the electrostatic latent image recorded on photoconductive surface 12 of belt 10. The electrostatic latent image attracts some toner particles from the developer material. Hence, toner particles are being continually depleted from the developer material. If additional toner particles are not furnished to the developer material, eventually the copies will become progressively lighter and degradate in quality. The denuded carrier granules and unused developer material advance with tubular member 66 in the direction of arrow 70 until the magnetic field produced by elongated magnetic member 68 no longer attracts the material thereto. At this time, the material falls freely from tubular member 66. Some of the developer material passes into auger 76 of the toner dispenser, indicated generally by the reference numeral 78. Toner dispenser 78 includes a hopper 80 stirring a supply of toner particles in chamber 82. The lower end portion of chamber 82 has an opening with auger 84 being positioned thereat. Auger 84 meters precise quantities of toner particles from chamber 82 of hopper 80. The toner particles are advanced to auger 76 which intermingles developer material and denuded carrier granules with the toner particles. Auger 76 substantially uniformly dispenses the mixture of developer material and toner particles into chamber 72 of housing 74 to maintain the concentration of toner particles within the developer material substantially constant. Agitator 88, positioned in chamber 82 of housing 80, rotates to prevent bridging and caking of the toner particles therein.

By way of example, elongated magnetic member 68 is a cylindrical member being made preferably from barium ferrite having a plurality of magnetic poles impressed about a portion of the circumferential surface thereof. Tubular member 66 is made preferably from aluminum having the exterior circumferential surface thereof roughened.

Figure 3:
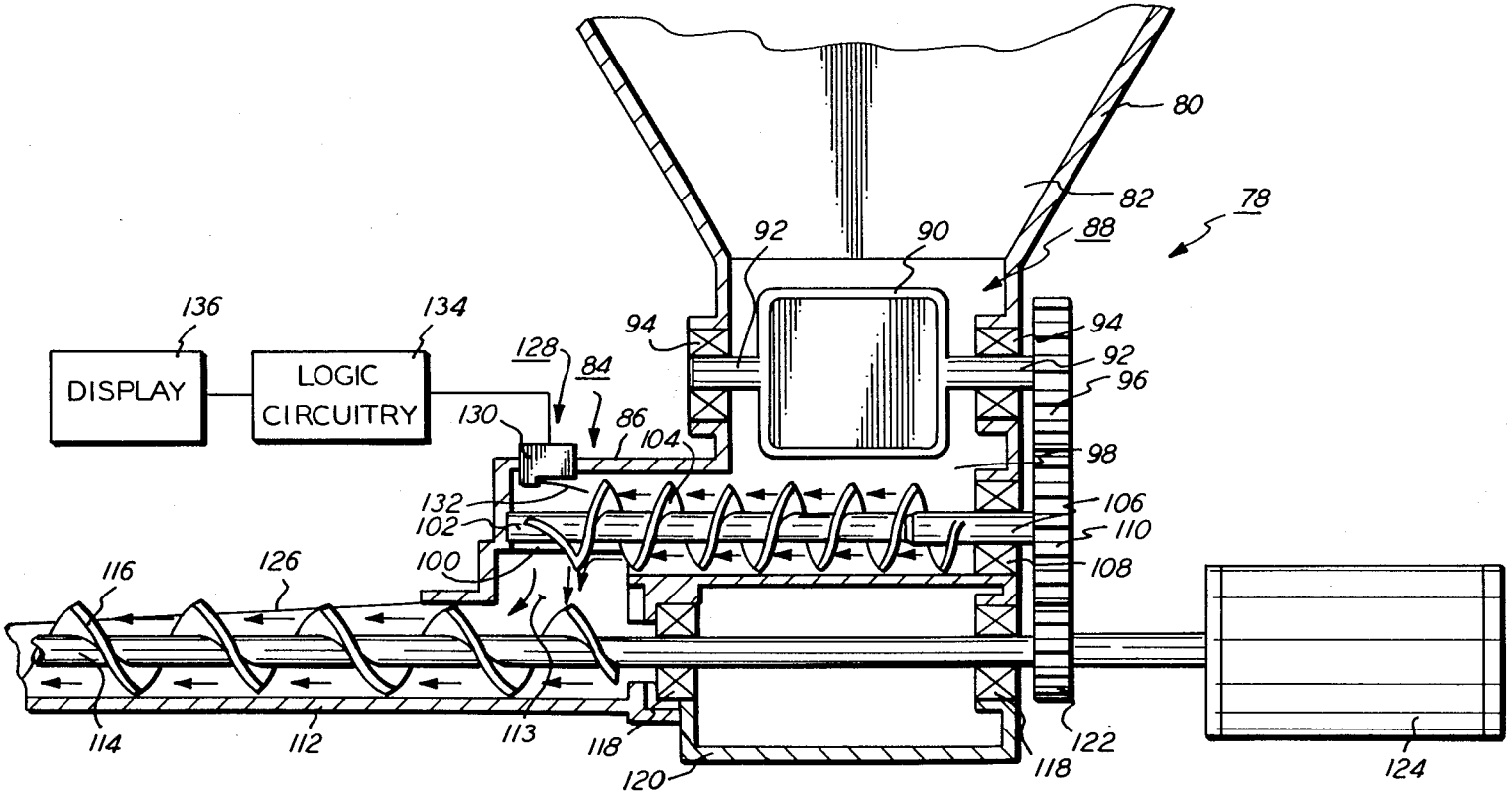
FIG. 3 is a fragmentary, side elevational view of the particle dispenser and low level detector of the FIG. 2 development system.

Turning now to FIG. 3, there is shown the detailed structure of toner dispenser 78. As shown thereat, agitator 88 comprises a rectangular frame 90 having shafts 92 extending outwardly therefrom. Shafts 92 are supported in bearings 94 mounted in the lower portion of hopper 80. One shaft has a gear 96 secured thereto. Auger 84 includes an enclosure 86 having an entrance port 98 disposed in the chamber of hopper 80 so as to receive toner particles being discharged from chamber 82. Enclosure 86 also has an exit port 100 for discharging a precisely metered quantity of toner particles into auger 76. Auger 84 includes a stationary shaft 102 extending in a longitudinal direction interiorly of enclosure 86. Helical member 104 is entrained about stationary shaft 102 and is adapted to rotate relative thereto. One end of helical member 104 is secured to shaft 106. Shaft 106 is supported in bearings 108 mounted in enclosure 86. Gear 110 is secured to shaft 106 and meshes with gear 96. Auger 76 includes a trough 112 having an entrance port 113 coupled to exit port 100 of auger 84. Thus, toner particles being metered from chamber 82 of hopper 80 are advanced along auger 84 and metered to auger 76. In addition, entrance port 100 receives developer material and denuded carrier granules from tubular member 66 (FIG. 2). This mixture of material is intermingled and advanced by auger 76 so as to be dispensed substantially uniformly therefrom into chamber 72 of housing 74 for replenishing the toner particles of the developer material contained therein. Auger 76 includes a shaft 114 having a helical member 116 secured thereto. Alternatively, shaft 114 may be omitted in lieu of a helical coil spring which may be used for auger 76. Helical member 116 is disposed interiorly of tubular member 112. Bearings 118 support shaft 114 in frame 120. Gear 122 is mounted on shaft 114 and meshes with gear 110. Motor 124 rotates shaft 114 and, in turn, gear 122. In this way, gears 110 and 96 are also driven so as to rotate helical members 116 and 104 as well as rectangular frame 90.

With continued reference to FIG. 3, a detector, indicated generally by the reference numeral 128, is positioned within enclosure 86 to sense the level of particles being advanced by helical member 104. Detector 128 includes a switch 130 having an elongated actuator arm 132, such as a suitable leaf spring. Actuator arm 132 rests on the particles being advanced by helical member 104. Furthermore, as helical member 104 rotates, the outer diameter of the auger periodically engages and supports actuator arm 132. When particles are being transported by helical member 104, actuator arm 132 is raised to an upward position closing switch 130. When the particles being transported are beneath a preselected quantity, actuator arm 132 moves in a downwardly direction opening switch 130. When switch 130 is open, logic circuitry 134 produces an output signal energizing display 136. Display 136 is a visual light display indicating to the machine operator that the particle level is low. Under these circumstances, the machine operator will replenish toner particles in chamber 82 of housing 80. In this way, the level of toner particles within the chamber 82 of housing 80 is being continually monitored and maintained at a minimum level to insure optimum copy quality during the development process.

In operation, toner particles in chamber 82 of hopper 80 are continuously agitated by the rotation of frame 90. These toner particles descend through the opening in hopper 80 into entrance port 98 of enclosure 86. Helical member 104 advances the toner particles along enclosure 86 to exit port 100. As the particles are being advanced, actuator arm 132 of switch 130 is maintained in a raised position maintaining switch 130 closed. Under these circumstances, logic circuitry 134 maintains display 136 in a de-energized condition. Alternatively, if the level of particles being advanced by helical member 104 along enclosure 86 were beneath a preselected value, switch 132 would be turned on by the movement of actuator arm 132 in a downwardly direction. It should be noted that actuator arm 132 will move in a reciprocating direction, i.e. up and down, due to the rotation of helical member 104 and the periodic engagement of switch actuator arm 132 with the outer diameter thereof. However, logic circuitry 134 processes the signal from switch 130 to provide an energization signal which causes display 136 to indicate to the machine operator that the toner particle level is beneath the preselected value. At this time, the toner particles are replenished by the machine operator and operation continues in a normal manner. Thus, the toner particles exiting port 100 fall into entrance port 113 of trough 112. Entrance port 113 also receives developer material from tubular member 66. This combination of materials is advanced by helical member 116 along trough 112 so as to be discharged over downward sloped edge 126 of trough 112. Inasmuch as trough 112 extends across chamber 72 of housing 74, the combination of toner particles and carrier granules is dispensed substantially uniformly over front edge 126. The slope of edge 126 of trough 112 is shaped to provide for substantially uniform dispensing of toner particles along the length of trough 112. This maintains the concentration of toner particles within the developer materials substantially constant.

In normal operation, motor 124 is continuously energized so as to dispense toner particles into the chamber of housing 74. The dispensing rate corresponds with the usage rate. However, actuation of motor 124 is initiated when the print button of the printing machine is depressed.

The intermingling of toner particles with carrier granules and developer material greatly facilitates the uniformity of dispensing. The carrier granules aid in the movement of the toner particles Furthermore, the carrier granules tend to minimize caking and clogging of the toner particles as they are being advanced. This further facilitates the operation of the particle level detector in that it insures that a clogged segment of toner particles will not give a spurious output reading indicating that the level of toner particles is above the desired level when, in fact, it is beneath the desired level.

In recapitulation, it is clear that the dispensing apparatus of the present invention includes an auger system having a particle level detector disposed therein for insuring that toner particles are maintained within the toner hopper. A system of this type minimizes cost and optimizes reliability. In this manner, the operator is automatically provided with a display depicting an out of toner condition and, may remedy the situation in a readily simple manner by adding additional toner particles to the hopper.

It is, therefore, evident that there has been provided, in accordance with the present invention, an apparatus for dispensing toner particles having a detector for indicating when the level of toner particles contained therein is beneath a preselected value. This apparatus fully satisfies the aims and advantages hereinbefore set forth. While this invention has been described in conjunction with a specific embodiment thereof, it is evident that many alternatives, modification and variations will be apparent to those skilled in the art. Accordingly, it is intended to embrace all such alternatives, modifications and variations as fall within the spirit and broad scope of the appended claims.

What is claimed is:

1. An apparatus for indicating the depletion of particles being dispensed into a development system, including:

means for storing a supply of particles therein;

means for discharging particles into the development system;

means for transporting particles from said storing means to said discharging means; and non-magnetic means, positioned in said transporting means for detecting the exhaustion of particles in said transporting means.

2. An apparatus according to claim 1, wherein said detecting means includes a switch operatively associated with said transporting means.

3. An apparatus according to claim 2, wherein said transporting means includes:

an enclosure having an entrance aperture for receiving particles from said storing means and an exit aperture for dispensing particles to said discharging means;

a helical member disposed interiorly of said enclosure; and means for rotating said helical member relative to said enclosure to transport particles received at the entrance aperture of said enclosure to the exit aperture thereof.

4. An apparatus according to claim 2, wherein said switch includes an actuator arm positioned in said enclosure, said actuator arm opening said switch in response to particles being exhausted from said enclosure.

5. An apparatus according to claim 4, wherein the particles being dispensed are toner particles.

6. An apparatus according to claim 5, wherein said discharging means includes:

a trough having an entrance port coupled to the exit aperture of said enclosure with a portion of the entrance port of said trough being arranged to receive developer material from the development system, and trough having a sloping edge for discharging the received toner particles and developer material to the remaining developer material in the housing;

a helical member mounted rotatably in said trough; and means for rotating said helical member relative to said trough to move the received toner particles and developer material therealong for discharge over the sloping edge thereof to the remaining developer material in the development system.

7. An apparatus according to claim 6, further including means, operatively associated with said storing means, for agitating the toner particles therein to facilitate dispensing therefrom.

8. An apparatus for developing an electrostatic latent imge recorded on a photoconductive member, including:

a housing defining a chamber for storing a supply of developer material therein;

a container for storing a supply of toner particles therein;

means, disposed in the chamber of said housing, for depositing developer material on the photoconductive member to develop the electrostatic latent image recorded thereon;

means for discharging toner particles into the chamber of said housing;

means for transporting toner particles from said container to said discharging means; and non-magnetic means, positioned in said transporting means, for detecting the exhaustion of toner particles in said transporting means.

9. An apparatus according to claim 8, wherein said detecting means includes a switch operatively associated with said transporting means.

10. An apparatus according to claim 9, wherein said transporting means includes:

an enclosure having an entrance aperture for receiving toner particles from said container and an exit aperture for dispensing toner particles to said discharing means;

a helical member disposed interiorly of said enclosure; and means for rotating said helical member relative to said enclosure to transport toner particles received at the entrance aperture of said enclosure to the exit aperture thereof.

11. An apparatus according to claim 10, wherein said switch includes an actuator arm positioned in said enclosure, said actuator arm opening said switch in response to toner particles being exhausted from said helical member.

12. An apparatus according to claim 11, wherein said discharging means includes:

a trough having an entrance port coupled to the exit aperture of said enclosure with a portion of the entrance port of said trough being arranged to receive developer material from the chamber of said housing, said trough having a sloping edge for discharging the received toner particles and developer material to the remaining developer material in the chamber of said housing;

a helical member mounted rotatably in said trough; and means for rotating said helical member relative to said trough to move the received toner particles and developer material therealong for discharge over the sloping edge thereof to the remaining developer material in the chamber of said housing.

13. An apparatus according to claim 11, further including means, operatively associated with said container, for agitating the toner particles therein to facilitate dispensing therefrom.

* * * * *